US006262006B1

(12) United States Patent
Silvani et al.

(10) Patent No.: US 6,262,006 B1
(45) **Date of Patent: *Jul. 17, 2001**

(54) DE-OILING COMPOSITION OF PERFLUOROPOLYETHERS AND HYDROFLUOROPOLYETHREAL SURFACTANTS

(75) Inventors: Rossella Silvani; Simonetta Fontana, both of Milan (IT)

(73) Assignee: Ausimont S.p.A., Milan (IT)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/025,647

(22) Filed: Feb. 18, 1998

(30) Foreign Application Priority Data

Feb. 20, 1997 (IT) ..... MI97A0361

(51) Int. Cl.[7] ..... C11D 3/20; C11D 3/37; C11D 3/44; C23G 5/032

(52) U.S. Cl. ..... 510/365; 510/475; 510/506; 252/364

(58) Field of Search ..... 510/365, 506, 510/475; 252/364

(56) References Cited

U.S. PATENT DOCUMENTS

| | | | | |
|---|---|---|---|---|
| 3,242,218 | | 3/1966 | Miller | 260/615 |
| 3,665,041 | | 5/1972 | Sianesi et al. | 260/615 A |
| 3,715,378 | | 2/1973 | Slamed et al. | 260/463 |
| 3,810,874 | * | 5/1974 | Mitsch et al. | 528/70 |
| 3,957,672 | | 5/1976 | Zisman et al. | 252/171 |
| 4,523,039 | | 6/1985 | Lagow et al. | 568/615 |
| 4,990,283 | * | 2/1991 | Visca et al. | 252/309 |
| 5,124,058 | * | 6/1992 | Corti et al. | 252/54 |
| 5,144,092 | | 9/1992 | Marraccini et al. | 568/615 |
| 5,354,552 | * | 10/1994 | Pantini et al. | 424/401 |
| 5,654,263 | * | 8/1997 | Abusleme et al. | 510/365 |
| 5,698,138 | * | 12/1997 | Visca et al. | 252/312 |
| 5,780,414 | * | 7/1998 | Silvani et al. | 510/365 |
| 6,096,240 | * | 8/2000 | Strepparola et al. | 252/194 |

FOREIGN PATENT DOCUMENTS

| | | |
|---|---|---|
| 0 148 482 | 7/1985 | (EP) . |
| 0 280 312 A2 | 8/1988 | (EP) . |
| 0 695 775 | 2/1996 | (EP) . |
| 0 805 199 A2 | 11/1997 | (EP) . |
| 1104482 | 2/1968 | (FR) . |
| 1194431 | 6/1970 | (GB) . |
| 6-210103 * | 8/1994 | (JP) . |
| 9-111286 * | 4/1997 | (JP) . |
| WO 96/13569 | 5/1996 | (WO) . |

OTHER PUBLICATIONS

Wolf G.C: "Cleaning Electronic Asemblies" Research Disclosure., No. 323, Mar. 1, 1991, Havant GB, p. 208 Xpooo176301.

* cited by examiner

*Primary Examiner*—Mark Kopec
*Assistant Examiner*—Brian P. Mruk
(74) *Attorney, Agent, or Firm*—Arent Fox Kintner Plotkin Kahn, PLLC.

(57) ABSTRACT

Compositions utilized to remove traces of organic solvents and/or oils from the surfaces of components comprising:
i) perfluoropolyethers;
ii) fluorinated additive having a structure selected from the following:

$$T—OR_f(CFY)—L \quad (I)$$

$$L—CF_2OR_fCF_2—L \quad (II)$$

with $L=X—CH_2CH_2(OCH_2CH_2)_nB$ wherein $X=CH_2O$, $CH_2NR''$, $CONR''$, $CH_2OCH_2CH_2NR''$, $CH_2OCOCH_2O$; B=OH, SH, NHR", $OCH_3$, $OCOCH_3$;
with R"=H, alkyl $C_{1-3}$; $Y=CF_3$ or F; T is selected among $—CF_3$, $—C_2F_5$, $—C_3F_7$, $ClCF_2CF(CF_3)—$, $CF_3CFClCF_2—$, $ClCF_2CF_2—$, $ClCF_2—$;
$R_f$ is a perfluoropolyether chain.

9 Claims, No Drawings

DE-OILING COMPOSITION OF PERFLUOROPOLYETHERS AND HYDROFLUOROPOLYETHREAL SURFACTANTS

The present invention relates to solvents utilizable as cleaning rinsing agents capable of removing traces of solvents, oils, greases, waxes, etc. from the substrates in general.

In particular as oils silicone oils, mineral oils and turpentines can be mentioned; as substrates, surfaces of metal components, plastic and glass material can be mentioned; as solvents, the organic ones, among which hydrocarbons, aliphatic esters, etc., can be mentioned.

More specifically the present invention relates to solvents capable of removing such substances without solubilizing them. The problem is particularly felt in industry where it is necessary to remove organic solvents or oils from the components coming into contact with the above mentioned materials during the cleaning or processing cycles. It is clear that after such removal process (de-solving and/or de-oiling) such components must result completely free of stains or residues.

A product meeting such requirements must not degrade, attack or modify the surface of the treated components.

Moreover, such product must result non-inflammable, non toxic, have no impact on the ozone (null ODP), must be thermally stable and capable of removing a wide range of solvents and oils even though its shows a poor or even null miscibility with the organic solvents and the oils to be removed.

The technical problem to be solved by the present invention relates to the need to have available solvents being not toxic and having the characteristics indicated above. Such a problem is particularly felt since the laws of the various countries have banned or are going to ban the use of most solvents utilized up to now owing to problems of impact on the ozone.

As an example of solvents which will not be utilized any longer due to their impact on the ozone, chlorinated solvents, chlorofluorocarbons (CFC) and in the future also hydrochlorofluorocarbons (HCFC) can be mentioned. The chlorofluorocarbons (CFC), in particular CFC-113, have been utilized for many years in various washing and drying processes. The above mentioned CFCs meet almost completely the characteristics mentioned above except for the high ODP which has even led to the banning.

The processes utilizing organic solvents or mineral and/or silicone oils are numerous.

Those having low molecular weight have the advantage of a quick drying, but have the drawback to be easily flammable since they have a low flash point. To overcome this drawback oils having a higher molecular weight are used. In this case the drawbacks are represented by the long time of drying and by the presence of stains and residues on the pieces after drying. Various techniques have been suggested to speed up and improve this processing step, such as hot air drying, drying under vacuum, air knife and in oven. This leads to various drawbacks such as for instance surface oxidations which modify the surface to be cleaned, sometimes hindering successive treatments such as painting or welding; prolongation of the processing times and utilization of more processing steps and consequently higher costs.

It has been unexpectedly and surprisingly found a composition capable of removing organic solvents and oils also with high molecular weight avoiding to use complex and expensive processes as pointed out above.

The present invention allows to remove organic solvents and silicone oils characterized by a relatively high boiling point, generally higher than 100° C.

An object of the present invention is a composition utilized to remove traces of organic solvents and/or oils from the surfaces of components comprising:

i) perfluoropolyethers having perfluoroalkylic end groups, optionally said groups containing hydrogen;

ii) fluorinated additive having a structure selected from the following:

$$T—OR_f(CFY)—L \quad (I)$$

$$L—CF_2OR_fCF_2—L \quad (II)$$

with $L=X—CH_2CH_2(OCH_2CH_2)_nB$ wherein $X=CH_2O$, $CH_2NR''$, $CONR''$, $CH_2OCH_2CH_2NR''$, $CH_2OCOCH_2O$;

$B=OH$, $SH$, $NHR''$, $OCH_3$, $OCOCH_3$;

with $R''=H$, alkyl $C_{1-3}$;

$Y=CF_3$ or F;

T is selected among $—CF_3$, $—C_2F_5$, $—C_3F_7$, $ClCF_2CF(CF_3)—$, $CF_3CFClCF_2—$, $ClCF_2CF_2—$, $ClCF_2—$;

$R_f$ is selected among the radicals of the type: A)

(per)fluoropolyethereal comprising repeating units randomly distributed along the polymer chain selected among:

$(CF_2CF_2O)$, $(CFYO)$ wherein Y is equal to F or $CF_3$, $(C_3F_6O)$ $(CF_2(CF_2)_zO)$ wherein z is an integer equal to 2 or 3, $(CF_2CF(OR_f)O)$, $(CF(OR_f)O)$ wherein $R_f$ is equal to $—CF_3$, $—C_2F_5$, $—C_3F_7$; $CR_4R_5CF_2CF_2O$ wherein $R_4$ and $R_5$ are equal to or different from each other and are selected among H, Cl or perfluoroalkyl, for instance with 1–4 C atoms;

and

B) perfluoroalkanes and hydrofluoroalkanes having molecular weight comprised between 300 and 1200.

The additive is preferably of formula (I).

The component i) is represented by highly fluorinated organic compounds having a pefluoropolyether structure (PFPE) free from chlorine and bromine, and having the above mentioned end groups. The PFPE repeating units are those indicated in $R_f$ in A).

The PFPE are chemically inert products and have a good compatibility with most of the fluorinated and non fluorinated materials commonly used in industry. They are not toxic, do not damage the ozone and are not flammable.

Since the organic solvents, the turpentines and the silicone oils are not mixible with PFPEs, the removal of traces of the above mentioned products cannot occur by simple dissolution, but by displacement.

In the component ii) the number average molecular weight of the (per)fluoroether part ($T—OR_f$ or $CF_2R_fCF_2$) is comprised between 500 and 1200 and the ratio by weight (K) between (per)fluorinated part and hydrogenated part is comprised between 1.5 and 3.5.

In particular the following $R_f$ fluoropolyethers can be mentioned as preferred:

$$—(CF_2CF(CF_3)O)_a(CFYO)_b— \quad (a)$$

wherein Y is F or $CF_3$; a and b are such numbers that the molecular weight is comprised in the range indicated below; a/b is comprised between 10 and 100; or the repeating units indicated in (a) can be combined as follows:

$$—(CF_2CF(CF_3)O)_a(CFYO)_b—CF_2(R'_f)_xCF_2—O—(CF_2CF(CF_3)O)_a(CFYO)_b—$$

wherein $R'_f$ is a fluoroalkylenic group, for instance from 1 to 4 C;

$$—(CF_2CF_2O)_c(CF_2O)_d(CF_2(CF_2)_zO)_h— \quad (b)$$

wherein c, d and h are integers such that the molecular weight is comprised in the range indicated below; c/d is comprised between 0.1 and 10; h/(c+d) is comprised between 0 and 0.05, z has the value indicated above, h can be also equal to 0;

$$—(CF_2CF(CF_3)O)_e(CF_2CF_2O)_f(CFYO)_g— \quad (c)$$

wherein Y is F or $CF_3$; e, f, g are integers such that the molecular weight is comprised in the range indicated below; e/(f+g) is comprised between 0.1 and 10, f/g is comprised between 2 and 10;

$$—(CF_2O)_j(CF_2CF(OR_{f''})O)_k(CF(OR_{f''})O)_l— \quad (d)$$

wherein: $R_{f''}$ is $—CF_3$, $—C_2F_5$, $—C_3F_7$; j,k,l are numbers such that the molecular weight is comprised in the range indicated below; k+l and j+k+l are at least equal to 2, k/(j+l) is comprised between 0.01 and 1000, l/j is comprised between 0.01 and 100;

$$—(CF_2(CF_2)_zO)_s— \quad (e)$$

wherein s is an integer such as to give the molecular weight indicated below; z has the meaning already defined;

$$—(CR_4R_5CF_2CF_2O)_{j'}— \quad (f)$$

wherein $R_4$ and $R_5$ are equal to or different from each other and are selected among H, Cl or perfluoroalkyl, for instance with 1–4 C atoms, j' being an integer such that the molecular weight is that indicated below; said unit inside the fluoropolyoxyalkylenic chain being combined between each other as follows:

$$—(CR_4R_5CF_2CF_2O)_{p'}—R'_f—O—(CR_4R_5CF_2CF_2O)_{q'}—$$

wherein $R'_f$ is a fluoroalkylenic group, for instance from 1 to 4 C, p' and q' are integers such that the molecular weight is that indicated above;

$$—(CF(CF_3)CF_2O)_{j''}— \quad (g)$$

j" being an integer such as to give the molecular weight indicated below; said units being connected each other in the fluoropolyoxyalkylenic chain as follows to have a bivalent radical:

$$—(CF_2CF(CF_3)O)_{a'}—CF_2(R'_f)_xCF_2—O—(CF(CF_3)CF_2O)_{b'}—$$

wherein $R'_f$ has the meaning indicated above, x is 0 or 1, a' and b' are integers and a'+b' is at least 1 and such that the molecular weight is that indicated below.

These structures comprising the indicated repeating units and the methods for preparing them are described in the patents GB 1,104,482, U.S. Pat. Nos. 3,242,218, 3,665,041, 3,715,378, 3,665,041, EP 148,482, U.S. Pat. Nos. 4,523,039, 5,144,092, and for the functional derivatives see U.S. Pat. No. 3,810,874. All these patents are incorporated herein by reference. The hydrofluoropolyethers of the present invention are obtained by decarboxylation processes of the alkaline salts obtained by hydrolysis and salification of the corresponding acylfluorides, through processes known in the art. For instance the decarboxylation is carried out in the presence of hydrogen-donor compounds, for instance water, at temperatures of 140–170° C. and under a pressure of at least 4 atm. See for instance European patent EP 695,775 and the examples reported therein, this patent is herein incorporated by reference.

The (per)fluoropolyether i) according to the present invention has a number average molecular weight Mn generally comprised between 300 and 1500, preferably between 400 and 800, and it is preferably a perfluoropolyether.

The (per)fluoropolyether has preferably a structure of the type:

$$T'—O—R_f—T''$$

wherein $R_f$ has the meaning indicated above and T' is selected among $—CF_3$, $—C_2F_5$, $—C_3F_7$; T" is selected among $—CF_3$, $—C_2F_5$, $—C_3F_7$, $—CF_2H$, $—CFHCF_3$, $—CF_2CF_2H$.

Particularly preferred structures are the following:

$$T'O(C_3F_6O)_{a''}(CF_2O)_{b''}T'' \quad (III)$$

a" and b" are integers such that the molecular weight is within the range indicated, a"/b" is comprised between 1 and 40; T' and T" are as defined above.

$$T'O(C_2F_4O)_p(CF_2O)_qT'' \quad (IV)$$

p and q are integers such that the molecular weight is within the range indicated, p/q is comprised between 0.6 and 1.2; T' and T" are as defined above.

$$T'O(C_3F_6O)_{s'}T'' \quad (V)$$

wherein s' is an integer such that the molecular weight is within the indicated range; T' and T" are as defined above.

The high efficacy of the compositions of the present invention allows the use of amounts of additive generally lower than or equal to 0.1% by weight, preferably lower than 0.05%. This represents a further advantage of the present invention since the additives can leave traces on the substrate and/or produce foams if utilized in high concentrations as it is generally required for the additives of the prior art.

For the processes for preparing additives, the above mentioned patents can be utilised, for instance by starting from a monofunctional or bifunctional (per)fluoropolyether, i.e., having —COF end groups, according to U.S. Pat. No. 3,810,874, herein incorporated by reference.

For instance, to prepare additives wherein X=$CH_2O$ and B=OH one starts from the product having —COF end group. The —COF group is reduced with metal hydrides to give the alcohol derivative $—CH_2OH$ which by treatment with 1 mole of ethylene oxide gives the monoaddition product $—CH_2O—CH_2CH_2OH$. The corresponding tosyl derivative is prepared by reaction with the chloride of the paratoluensulphonic acid. The tosyl derivative is then reacted with a large excess of polyethylenglycol monocomponent in the presence of potassium terbutylate. For the other bridging bonds X one follows the teaching of U.S. Pat. No. 3,810,874 mentioned above.

The compositions of the invention allow a removal of the oily substances even higher than 97%. The amount which remains on the subtrate is easily removable by evaporation.

The substrates which can be treated with the solvents of the invention generally are both of organic and inorganic type. Metals, ceramic or glass materials, polymeric substrates can be mentioned.

The removal of the oily products can be carried out according to known techniques: immersion or spray. In the case of immersion, the contact between solvent of the invention and surface to be cleaned can be favoured by utilizing an ultrasonic bath, which allows to remove more effectively also the solid contaminants.

Among the oily substances and the organic solvents which can be removed there are, as already said, silicone, fluorosilicone oils, hydrogen-based oils and solvents based on hydrocarbon mixtures. A further advantage of the composition of the present invention resides in that it removes without solubilizing the above indicated substances. The advantage not to bring the oil in solution consists in that it is possible to recycle the solvent by utilizing simple physical operations without having to use distillation. Therefore the removal process according to the present invention results very simplified.

The silicone-based oils are well known and are generally polymethylsiloxanes having different viscosity, for instance from 50 to 30.000 cSt.

Among the fluorosilicones, the trifluoropropylmethylpolysiloxane can be mentioned.

By oils having an hydrogenated basis it is meant products based on mineral oils derived from petroleum or on synthetic or semisynthetic oils. Mineral turpentines, polyalphaolefins, mineral oils such as for instance the ester dimer, can be mentioned.

With the present invention it is possible to remove also traces of organic solvents based on hydrocarbon mixtures and aliphatic esters, such as for instance the commercial product Axarel® 9100.

The present invention will now be better illustrated by the following working examples, which have a merely illustrative purpose but not limitative of the scope of the invention itself.

EXPERIMENTAL PART

The used solvents (perfluoropolyethers) are commercially available and differ in number average molecular weight and, consequently, in boiling point and viscosity.

EXAMPLE 1

(De-solving)

The utilized samples (metal plates and electron components) were washed with an organic solvent, commercially available, Axarel® 9100. Such solvent is formed by a mixture of aliphatic hydrocarbons ((96–99% by weight) and of aliphatic esters (4–1% by weight). It has a boiling point between 221° C. and 277° C., flash point of 96° C. and results flammable. The samples in question are immersed for 1–2 minutes in a bath containing PFPE having the following structure:

$$CF_3O(C_3F_6O)_{1,8}(CF_2O)_{0,1}CF_3$$

Such PFPE has a boiling point of about 90° C. and number average molecular weight equal to 460. The PFPE is then additivated with 0.1% by weight of the fluorinated additive having the following structure:

$$CF_3O(C_3F_6O)_3(CF_2O)_{0,2}CF_2CH_2OCH_2CH_2(OCH_2CH_2)_4OH$$

The samples were then dried and afterwards weighed to determine the residual amount of Axarel® 9100 remained on the surface. The removed amount of solvent resulted equal to 99.5% by weight.

EXAMPLE 2

(Comparative)

The test described in Example 1 was repeated by utilizing pure PFPE without addition of fluorinated additive. The amount of Axarel® 9100 removed from the samples surface resulted lower than 90% by weight.

EXAMPLE 3

(Comparative)

Example 2 was repeated by utilizing an ultrasonic bath to improve the quality of the cleaning process. The amount of Axarel® 9100 removed from the surface resulted equal to about 96% by weight.

EXAMPLE 4

(De-oiling)

The PFPE of Examples 1–3 was utilized to verify the capacity of removing silicone oils from the surface of the samples in question. As described in the previous examples, a known amount of silicone oil was uniformly distributed on the samples surface. Such samples were successively immersed in a bath containing PFPE additivated with 0.1% by weight of the fluorinated additive of Example 1.

The silicone oils considered were the following:

- Mesilicone 50: methylsilicone oil having viscosity equal to 50 cSt commercialized by Dow Corning;
- Mesilicone 500: methylsilicone oil having viscosity equal to 500 cSt commercialized by Dow Corning;
- FS® 1265: fluorosilicone oil having viscosity equal to 1,000 cSt commercialized by Dow Corning;
- DC® 200: silicone oil having viscosity equal to 12,000 cSt commercialized by Dow Corning.

One proceeded then as described in Examples 1–3 and the measured amount of the removed silicone oil is reported in Table I.

EXAMPLE 5

(Comparative)

Example 4 was repeated by utilizing pure PFPE, i.e. without fluorinated additive. The amounts of the removed silicone oil from the samples surface are reported in Table II.

EXAMPLE 6

(De-oiling)

The PFPE of Examples 1–5 was utilized to verify the capacity to remove mineral oils and turpentines from the surface of the above samples. The samples were, then, immersed in a bath containing PFPE additivated with 0.1% by weight of the fluorinated additive of Example 1.

One proceeded then exactly as in the Examples described above utilizing, however, the following oils:

- Polyalphaolefin (PAO®) having viscosity equal to 40 cSt commercialized by Itec;
- Ester dimer PRIOLUBE® 3967 commercialized by Unichem International;
- Dearomatized turpentine D® 40 commercialized by Exxon.

The amounts of removed oil are reported in Table III.

EXAMPLE 7

(Comparative)

The test of Example 6 was repeated by utilizing only the pure PFPE without addition of fluorinated additive. The amounts of removed oil are reported in Table IV.

TABLE I

| USED SILICONE OILS | AMOUNT OIL REMOVED |
|---|---|
| Mesiliconic 50 | 98% by weight |
| Mesiliconic 500 | 92% by weight |
| FS ® 1265 | 92% by weight |
| DC ® 200 | 91% by weight |

TABLE II

| USED SILICONE OILS | AMOUNT OIL REMOVED |
|---|---|
| Mesiliconic 50 | 93% by weight |
| Mesiliconic 500 | 62% by weight |
| FS ® 1265 | 74% by weight |
| DC ® 200 | 49% by weight |

TABLE III

| UTILIZED OILS | AMOUNT OIL REMOVED |
|---|---|
| PAO | 94% by weight |
| PRIOLUBE ® 3967 | 98% by weight |
| D ® 40 | 99% by weight |

TABLE IV

| UTILIZED OILS | AMOUNT OIL REMOVED |
|---|---|
| PAO | 85% by weight |
| PRIOLUBE ® 3967 | 88% by weight |
| D ® 40 | 91% by weight |

What is claimed is:

1. Composition for removing traces of organic solvents and/or oils from the surfaces of components consisting of:

i) perfluoropolyethers having perfluoroalkylic end groups, said groups optionally containing hydrogen;

ii) fluorinated additive having a structure selected from the following:

$$T—OR_f(CFY)—L \quad (I)$$

$$L—CF_2OR_fCF_2—L \quad (II)$$

with L=—X—$CH_2CH_2(OCH_2CH_2)_nB$;

wherein X=$CH_2O$, $CH_2NR''$, $CONR''$, $CH_2OCH_2CH_2NR''$, $CH_2OCOCH_2O$;

B=OH, SH, NHR", $OCH_3$, $OCOCH_3$;

with R"=H, alkyl $C_{1-3}$;

Y=$CF_3$ or F;

T is selected from the group consisting of —$CF_3$, —$C_2F_5$, —$C_3F_7$, $ClCF_2CF(CF_3)$—, $CF_3CFClCF_2$—, $ClCF_2CF_2$—, and $ClCF_2$—;

the number average molecular weight of the perfluoroethereal part T—$OR_f$ or $CF_2OR_fCF_2$ of ii) is between 500 and 1200 and n is such that the ratio (K) by weight between a (per) fluorinated part T—$OR_f(CFY)$ or $CF_2OR_fCF_2$ and a hydrogenated part (—L) is between 1.5 and 3.5:

$R_f$ is selected from the group consisting of the radicals of the type:

A)

(per) fluoropolyethereal consisting of repeating units randomly distributed along the polymer chain selected from the group consisting of:

$(CF_2CF_2O)$, (CFYO) wherein Y is equal to F or $CF_3$, $(C_3F_6O)$, $(CF_2(CF_2)_zO)$ wherein z is an integer equal to 2 or 3, $(CF_2CF(OR_f)O)$, $(CF(OR_f)O)$ wherein $R_f$ is equal to —$CF_3$, —$C_2F_5$; —$C_3F_7$; $CR_4R_5CF_2CF_2O$ wherein $R_4$ and $R_5$ are equal to or different from each other and are selected among H, Cl or perfluoroalkyl; and

B)

perfluoroalkanes and hydrofluoroalkanes having molecular weight comprised between 300 and 1200.

2. Composition according to claim 1 wherein the component ii) has the formula (I).

3. Composition according to claim 1 wherein $R_f$ comprises the repeating units (CFYO), wherein Y is equal to F or $CF_3$, and $(C_3F_6O)$.

4. Composition according to claim 1, wherein the component i) has perfluoroalkylic end groups, optionally in admixture with perfluoropolyethers with hydrogenated end groups.

5. Composition according to claim 1 wherein in the component ii) $R_f$ is selected from the group consisting of fluoropolyethers having the following repeating units:

$$—(CF_2CF(CF_3)O)_a(CFYO)_b— \quad (a)$$

wherein Y is $F^-$ or $CF_3$; a and b are such numbers that the molecular weight is comprised between 300 and 1500 and a/b is comprised between 10 and 100; or the repeating units indicated in (a) can be bound as follows:

$$—(CF_2CF(CF_3)O)_a(CFYO)_b—CF_2(R'_f)_xCF_2—O—(CF_2CF(CF_3)O)_a(CFYO)_b—$$

wherein $R'_f$ is a fluoroalkylenic group, $$—(CF_2CF_2O)_c(CF_2O)_d(CF_2(CF_2)_zO)_h— \quad (b)$$

wherein c, d and h are integers such that the molecular weight is comprised in the range indicated in (a); c/d is comprised between 0.1 and 10; h/(c+d) is comprised between 0 and 0.05, z has the value indicated above, h can also be equal to 0;

$$—(CF_2CF(CF_3)O)_e(CF_2CF_2O)_f(CFYO)_g— \quad (c)$$

wherein Y is F or $CF_3$; e, f, g are integers such that the molecular weight is comprised in the range indicated in (a); e/(f+g) is comprised between 0.1 and 10, f/g is comprised between 2 and 10;

$$—(CF_2O)_j(CF_2CF(OR_{f''})O)_k(CF(OR_{f''})O)_l— \quad (d)$$

wherein: $R_{f''}$ is —$CF_3$, —$C_2F_5$, —$C_3F_7$; j,k,l are numbers such that the molecular weight is comprised in the range indicated in (a); k+l and j+k+l are at least equal to 2, k/(j+l) is comprised between 0.01 and 1000, l/j is comprised between 0.01 and 100;

$$—(CF_2(CF_2)_zO)_s— \quad (e)$$

wherein s is an integer such as to give the molecular weight indicated in (a); z has the meaning already defined;

$$—(CR_4R_5CF_2CF_2O)_{j'}— \quad (f)$$

wherein $R_4$ and $R_5$ are equal to or different from each other and are selected among H, Cl or perfluoroalkyl, for instance with 1–4 C atoms, j' being an integer such that the molecular weight is that indicated in (a); said unit in the fluoropolyoxyalkylenic chain being combined between each other as follows:

$$—(CR_4R_5CF_2CF_2O)_{p'}—R'_f—O—(CR_4R_5CF_2CF_2O)_{q'}—$$

wherein $R'_f$ is a fluoroalkylenic group, for instance from 1 to 4 C, p' and q' are integers such that the molecular weight is that indicated in (a);

$$—(CF(CF_3)CF_2O)_{j''}— \quad (g)$$

j" being an integer such as to give the molecular weight indicated in (a); said units being combined each other in the fluoropolyoxyalkylenic chain as follows to have a bivalent radical:

$$—(CF_2CF(CF_3)O)_{a'}—CF_2(R'_f)_xCF_2—O—(CF(CF_3)CF_2O)_{b'}—$$

wherein $R'_f$ has the meaning indicated above, x is 0 or 1, a' and b' are integers and a'+b' is at least 1 and such that the molecular weight is that indicated in (a).

6. Composition according to claim 1 wherein the component i) has the repeating units indicated in claim 6.

7. Composition according to claim 1, wherein the amount of component ii) is lower than or equal to 0.1% by weight.

8. A method for removing an oily substance from a substrate comprising, contacting the substrate having the oily substance thereon with the composition as set forth in claim 1.

9. The method according to claim 8 wherein the oily substances to be removed from a substrate are selected from the group consisting of silicone, fluorosilicone oils, oils having a hydrogenated basis and solvents based on hydrocarbon mixtures.

* * * * *